United States Patent [19]

Allais et al.

[11] Patent Number: 4,617,852

[45] Date of Patent: Oct. 21, 1986

[54] MILITARY EQUIPMENT COMPRISING A TURRET HAVING A MAIN EXTERNAL WEAPON

[75] Inventors: Jean-Philippe P. B. Allais, Le Havre; Francis J. M. G. Trémouilles, Merignac, both of France

[73] Assignee: Hispano-Suiza, Saint-Cloud, France

[21] Appl. No.: 608,488

[22] Filed: May 8, 1984

[30] Foreign Application Priority Data

May 9, 1983 [FR] France ..... 83 08013

[51] Int. Cl.[4] ..... F41F 9/06; F41F 21/14; F41H 5/20

[52] U.S. Cl. ..... 89/36.13; 89/45; 89/47

[58] Field of Search ..... 89/45, 46, 47, 36.13

[56] References Cited

U.S. PATENT DOCUMENTS 4,381,693 5/1983 Dumez ..... 89/36.13

FOREIGN PATENT DOCUMENTS 2948146 6/1980 Fed. Rep. of Germany ..... 89/47
1487653 10/1977 United Kingdom ..... 89/47
1490112 10/1977 United Kingdom ..... 89/47

*Primary Examiner*—Stephen C. Bentley
*Attorney, Agent, or Firm*—Larson & Taylor

[57] ABSTRACT

The military equipment comprises a turret mounted for rotation about a vertical axis and supporting, by means of a swivelling device with horizontal axis, a main heavy gun totally external to the turret, having its own shield and situated approximately in a plane passing through the axis of rotation of the turret. The swivelling device comprises two lateral supports surrounding the gun and supporting the latter via bearings so as to define an elevation axis situated behind the rotational axis of the turret. One of the supports and the shield of the gun have oppositely situated openings for forming a protected channel for a gun loading system supplying the gun with rounds of ammunition from inside the turret. The feed system constitutes a unitary assembly. It has a frame secured in the gun shield on which a carriage is transversely movable between a position where an ammunition craddle supported by the carriage is aligned with a weapon and a position lateral to the weapon. The loading craddle is movable between a rear position for transport by the carriage and a front position accessible from inside the turret for placing a piece of ammunition therein.

13 Claims, 4 Drawing Figures

MILITARY EQUIPMENT COMPRISING A TURRET HAVING A MAIN EXTERNAL WEAPON

BACKGROUND AND SUMMARY OF THE INVENTION

The invention relates to military equipment of the kind described in European Patent EP A-No. 23441 comprising a turret mounted for rotation about a vertical axis and supporting, by means of a swivelling device with horizontal axis, a main heavy gun totally external to the turret, having its own shield and being approximately in a plane passing through the axis of rotation of the turret, the swivelling device comprising two lateral supports surrounding the gun and supporting the latter (or a part joining it to the lateral supports) via bearing means so as to define an elevational swivelling axis situated behind the rotational axis of the turret, one of the supports and the armour plating of the weapon having oppositely situated openings for forming a protected feed channel for a system for supplying the weapon shot by shot with ammunition from inside the turret.

This arrangement has a number of advantages. On the other hand, it requires causing each round of ammunition to follow a defined path in its turn. A gun loading system given by way of example in U.S. Pat. No. 4,381,693(Dumez) comprises a conveyor passing through one of the supports and allowing the rounds of ammunition to be brought one at a time from a manual loading station, situated in the turret, to a transfer station situated in the armour plating of the main weapon itself, whence it is taken up again by a mechanism for shifting the piece of ammunition laterally then introducing it axially into the breech. As a counterpart to the convenience which this arrangement offers the gunner, it requires a conveyor capable of accomodating considerable modifications of the position of the transfer station with respect to the manual loading station.

It is an object of the invention to provide military equipment of the above defined kind comprising a loading system of relatively simple construction, which accomodates large elevational deflection of the weapon, and simple to mount.

With this end in view, the invention provides equipment whose feed system forms an integrated assembly intended to be placed inside the armour plating of the weapon, having means for transversely moving a carriage over slides belonging to a plate capable of being fixed to the armour plating between an axial position where an ammunition cradle supported by the carriage is aligned with a weapon and a position lateral to the weapon, and means for moving the loading cradle between a rear position for transport by the carriage and a front position accessible from inside the turret for placing a piece of ammunition therein.

The cradle is formed advantageously by a tube open along a generatrix whose ends are suspended from a chain for moving it and swinging it from front to rear, which tube is provided with means for retaining the ammunition in the tube and is able to support those for introducing it axially into the weapon.

The invention will be better understood from reading the following description of a particular embodiment, given by way of non limiting example.

SHORT DESCRIPTION OF THE DRAWINGS

DETAILED DESCRIPTION OF AN EMBODIMENT

Figure 1:
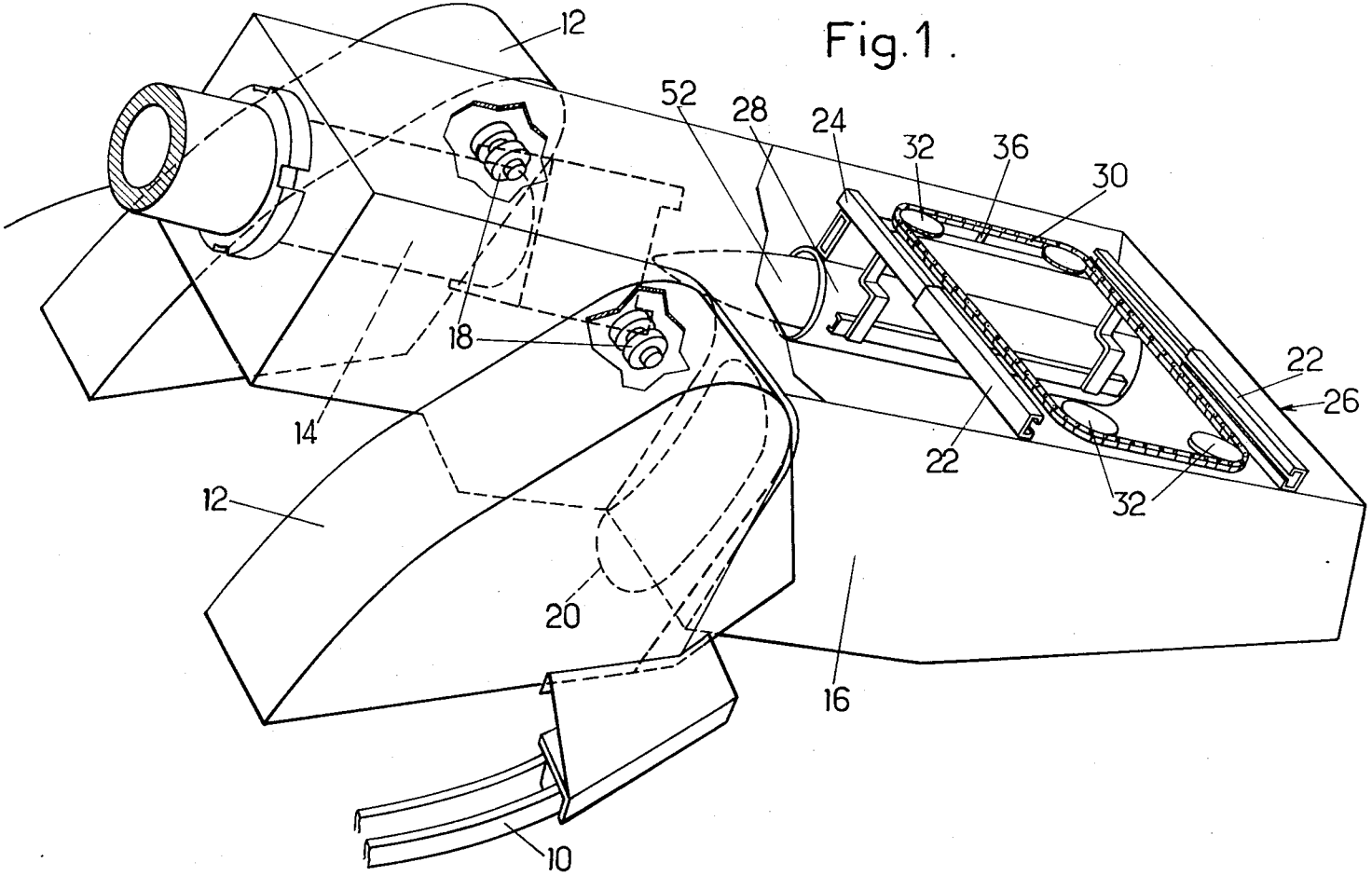
FIG. 1 is a phantom perspective view showing the relative arrangement of the supports of the weapon and of the armour plating of this latter, as well as the feed system in the condition in which it finds itself just before loading the ammunition into the weapon.
Figure 2:
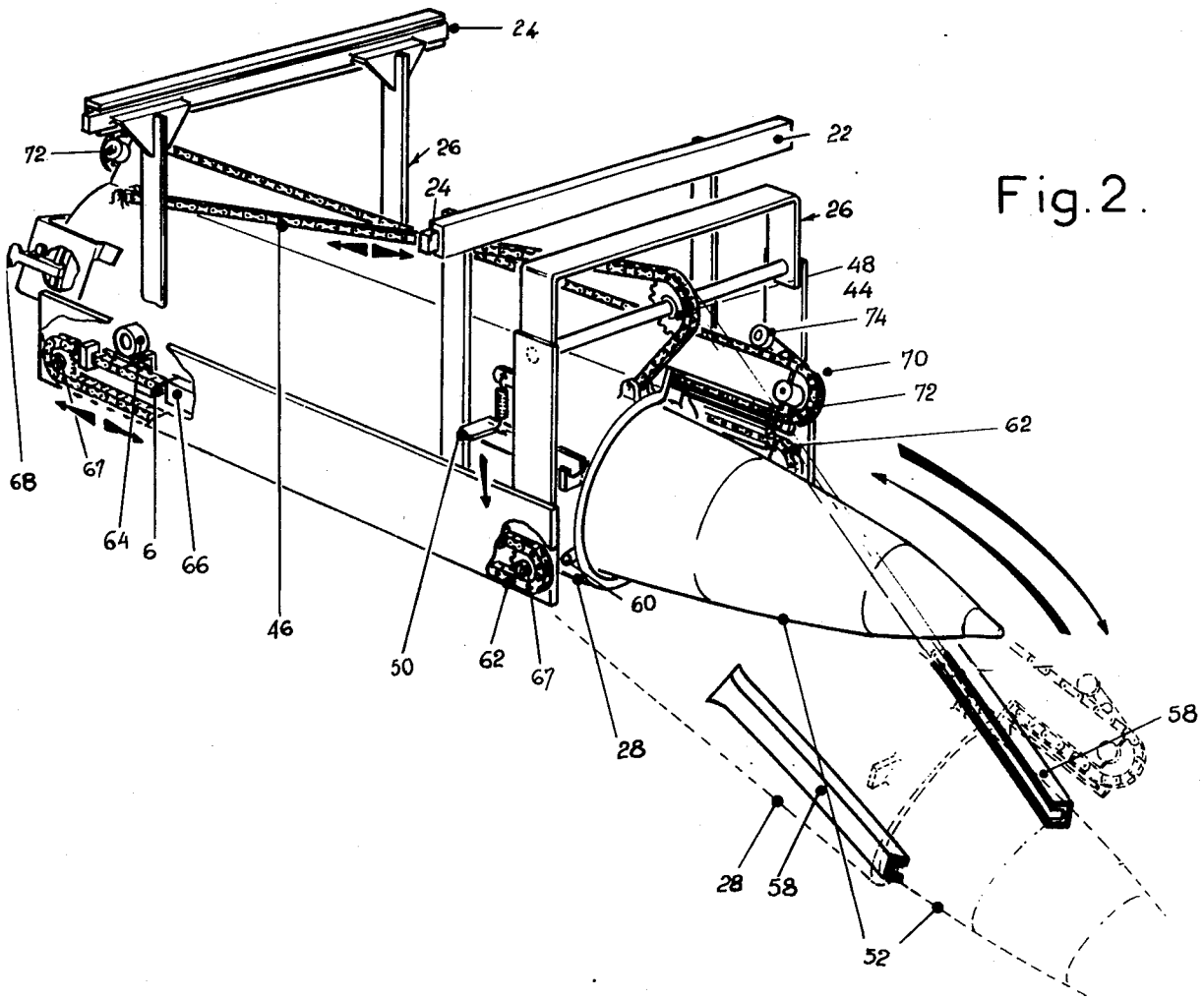
FIGS. 2 and 3 are detail perspective views showing respectively an example of a typical carriage of the feed system in a lateral position and in an axial position.
Figure 3:
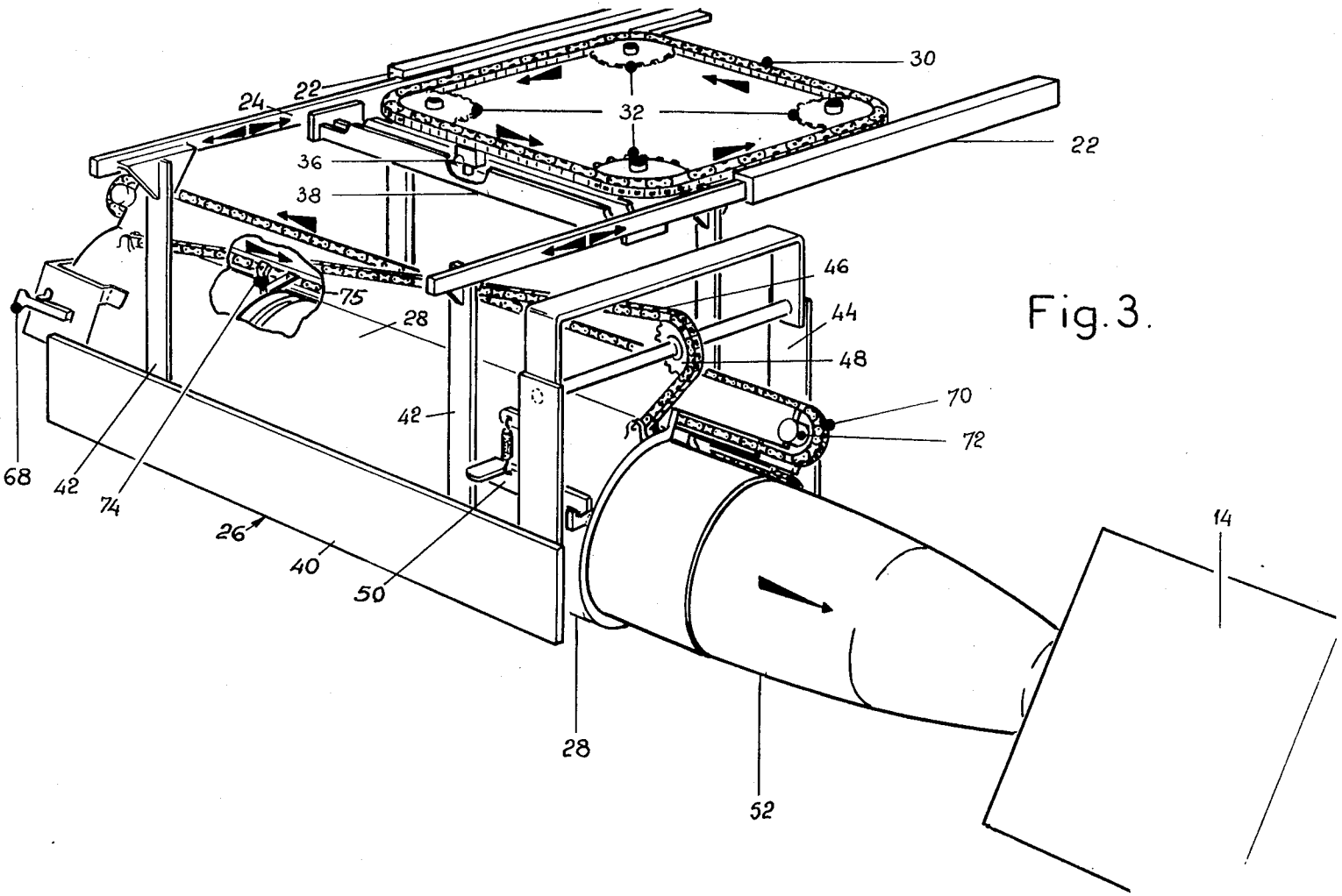

Referring to FIGS. 1–3, a feed system forms an integrated assembly comprising a plate for mounting on the internal wall of the armour plating of the weapon, able to be constructed and adjusted independently of the weapon. The feed system may be more particularly used on an armoured vehicle turret of the the kind shown in FIG. 4, similar to the one described in U.S. Pat. No. 4,381,693. This turret comprises a ring 10 for rotating the turret about a vertical axis. It is provided with two vertical supports 12 surrounding a main weapon 14 of medium or large caliber, requiring shot by shot loading, and having its own armour plating 16. The elevational swivelling axis of the weapon is defined by two swivel pins 18 with which it is provided and which rotate in bearings, not shown, provided in supports 12.

The shot by shot loading of the weapon with ammunition stored under the turret takes place through one of supports 12, which is hollow and of a sufficient internal width so that the gunner placed in the turret may introduce therein the ammunition which he has taken from one of the storage positions provided in the turret. A protected passage between support 12 and armour plating 16 is formed by cooperating openings 20 provided in the facing faces which have a sufficient angular development for providing overlapping whatever the elevational aiming of the weapon may be.

The feed system placed in the armour plating 16, comprises a fixed plate (not shown) intended to be fixed to the armour plating, having at least two slides 22 which are horizontal when the axis of the turret is vertical. These two slides 22, rectilinear (case of the Figures) or not, may be orthogonal to the axis of the weapon 14 or not. They support sliders 24 belonging to a carriage 26 and allowing the carriage to move between an axial position (Figures 1 and 3) and a lateral position (FIG. 2). When carriage 26 is in its axial position, a tube shaped cradle 28 which it supports is coaxial to the weapon. When it is in a lateral position, the carriage frees the space required for the recoil of the weapon and, possibly, for ejection of the shell case or of the unusable ammunition.

A drive mechanism is provided for moving carriage 26 between these two positions. This mechanism (FIG. 3) comprises an endless chain 30 passing over four pinions 32 whose shafts are parallel, disposed at the four corners of a rectangle and integral with slides 22. One of these pinions is provided with a drive member (not shown) such as an electric motor driven reducer, whereas the other pinions only play a guiding role. Chain 30 comprises a drive finger 36 intended to travel in a cross piece 38 joining together sliders 24, generally perpendicular to these sliders. The position of this drive finger 36 defines the position of the carriage.

Carriage 26 comprises, in addition to sliders 24 and cross piece 38, a structure for supporting the tubular cradle 28. In the embodiment shown, this structure comprises lateral plates 40 for supporting the mechanism, fixed by plates 42 to the sliders 24, and a stirrup 44 fixed to plates 40. Cradle 28 is suspended from stirrup 44 by at least one chain 46 which allows it to swing in a vertical plane between the positions shown with continuous lines and broken lines in FIG. 2. Chain 46 passes over a pinion 48 supported by a shaft perpendicular to cradle 28, which pinion is supported by stirrup piece 44 at the front of the carriage. The ends of the chain are fixed one to the front and the other to the rear of cradle 28. This chain is disposed so as to allow the tubular cradle to descend into the turret when it advances. Instead of providing suspension chain 46, or in addition to this chain, front converging guides 58 may be provided for receiving studs 60 fixed to the front of the tubular cradle 28 (a partial representation of which is given).

The forward and rearward movements of cradle 28 are controlled by two control chains 62 placed, one on the right and the other on the left of the cradle. These chains are connected to the cradle by supports 64. The chains may be guided in a gutter 66 forming a slide or may be provided with roller supports and driven by pinion 67. The downward and upward movements (advance or backward movement) of cradle 28 may be provided by controlling one of pinions 67 of chains 62, with or without a mechanical connection between the homologous pinions of the two chains 62. Chains 62 may moreover be replaced by an actuating cylinder controlling supports 64, forming half shafts moving in slides.

The cradle is also provided with means for holding the ammunition 32 in place and means for pushing the ammunition forwards and introducing it into the shaft. The locking means may be formed by a rear bolt 68 (FIGS. 2 and 3) with automatic uncocking during the introduction. The means for loading the ammunition into the weapon, when cradle 28 is in an axial position, comprise a loading chain 70 stretched over pinions 72 rotating on the cradle. One of pinions 72 is provided with a drive motor. The loading chamber 70 has a finger 74 (FIG. 3) for causing the ammunition to slide forwards into cradle 28. The arrival of this loading finger 74 at the rear of the ammunition causes uncocking of bolt 68 securing the ammunition in the cradle. A microswitch or a proximity detector (not shown) is provided on cradle 28 for stopping the loading chain when the ammunition has been introduced into the weapon. Fingers 74 may be mounted on an actuating cylinder with axis adjacent to the endless chain 70.

The operating sequence of the feed system which has just been described may be considered as comprising three phases which will be described successively.

The first phase comprises the positioning of the ammunition in the tubular loading cradle by the gunner and the raising of this ammunition into the barrel compartment defined by the armour plating of the weapon. With the cradle in the position shown with broken lines in FIG. 2, the gunner fits the ammunition into the tubular cradle out whatever the elevational aim of the weapon, at least within a predetermined range. The motor driving chain 62 is supplied with the power to cause cradle 28 to draw back and swing and to bring it into the position shown with a continuous line in FIG. 2. As a general rule, this operation will be carried out under the control of the gunner. The succession of operations may be carried out either under the control of a sequential automatic device, or in response to individual controls supplied by the gunner of the weapon. After this first phase, the cradle is secured against movement on the carriage by bolt 50 which is automatically engaged as soon as the carriage arrives in the rear position.

The second Figure comprises the lateral transfer of the ammunition contained in its cradle and holding it in place during loading. At the beginning of this phase, the tubular cradle is in a lateral position. Movement of the carriage is effected by actuating the motor driven reducer controlling chain 30. This latter drives finger 36 which brings carriage 26 from the lateral position to the axial position. Once in the axial position, the carriage 26 is locked laterally by finger 36 passing over a contact fixed at the front of cross piece 38. Then the finger is immobilized or slowed down in the cross piece during the third phase.

This stopping of the locking finger 36 in the cross piece is caused by its passing in front of a microswitch or proximity detector, not shown.

The third phase is formed by loading the ammunition into the barrel, the carriage being in an axial position. The operation is carried out by driving chain 70. Finger 74 of this chain, initially carried by the upper side comes to bear on the bottom of the ammunition and drives this latter into the weapon while sliding along a slit 75 of craddle 28 (FIG. 3). Once the loading has been carried out, the cradle must be brought back to its initial position by the movements which are the reverse of those which have just been described. Return of the carriage to the lateral position is effected by laterally unlocking the mobile carriage, then by lateral movement of finger 36 (leftwards of the barrel compartment in the case illustrated). When cross piece 38 has come back to the lateral position, the rearward movement of the finger locks carriage 26 again in the lateral direction. The gunner may then control swinging of the cradle, uncocking of bolt 50 taking place at the same time as the control of the motor driven reducer acting on the drive pinion or pinions 67.

In this new position, a new piece of ammunition may be placed in the cradle, the reloading sequence however only being undertaken after firing or ejection of the ammunition in place.

Figure 4:
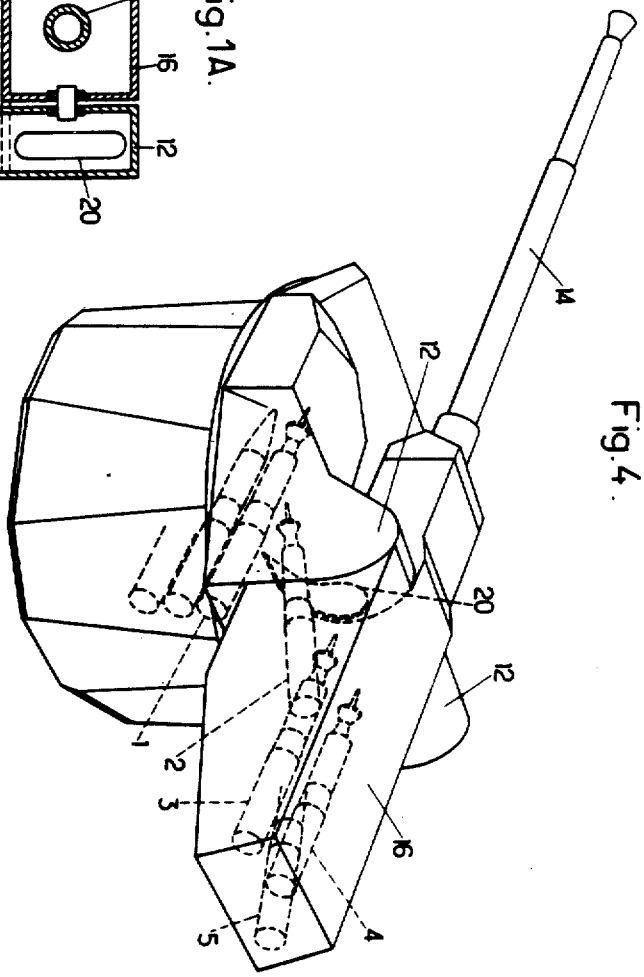
FIG. 4 is a general view of a turret equipped with a feed system in accordance with the invention.

It can be seen then that the ammunition assumes successively the positions shown in FIG. 4 at 1 (taking up by hand), 2 (raising, whatever the angle of elevation), 3 (transfer towards the axis of the barrel accompanied by ejection of the previous shell case at 5), and 4 (introduction).

We claim:

1. Military equipment comprising: a turret mounted on a mount for rotation about a substantially vertical axis; a pair of side members secured to said turret and projecting upwardly therefrom; bearing means carried by said side members and defining an elevation axis transverse to said vertical axis; a main gun of a caliber greater than that suitable for belt feed of ammunition and located out of and above said turret, carried by said bearing means and provided with a separate shield fast with said gun, said bearing means cooperating with the shield of the gun to define a protected passage; and a gun loading system, at least a portion of which is located in said protected passage, arranged to carry one round of ammunition at a time from a predetermined location and to insert said round into a firing chamber of said gun, said loading system being arranged to accomodate the variations in elevation, wherein said gun loading system constitutes a unitary assembly located within said separate shield and comprises a frame constructed and arranged to be secured to said separate shield, a slideway carried by said frame, a carriage supporting a craddle arranged to receive one round of ammunition at a time and slidably received on said slideway for movement between an axial position where said craddle supported by the carriage is aligned with said gun and a position lateral to said gun, means for moving said craddle parallel to said gun between a rear position for transport by the carriage and a front position accessible from inside the turret for placing one round of ammunition therein, and wherein said means for moving said craddle are arranged to subject said craddle to a swinging movement about a horizontal axis transverse to the axis of said gun when moving said craddle from said rear position where an axis of said craddle is parallel to said gun and a front position where said axis of said craddle has a forward slope, whereby placing of one round of ammunition is rendered easier.

2. Military equipment according to claim 1, wherein said craddle comprises a tube whose end portions are suspended from chain means associated with driving means for moving said tube forwardly and rearwardly while subjecting said tube to a swinging movement about a horizontal axis transverse to the axis of said tube, said tube being provided with means for retaining said round of ammunition within said tube.

3. Military equipment according to claim 2, wherein one of the end portions of said tube is provided with rollers supported by means for guiding said tube during forward and rearward movement thereof.

4. Military equipment according to claim 2, wherein said tube is formed with a longitudinal slit, further comprising means for axially ramming said round of ammunition from the tube into the firing chamber which comprises a finger projecting into said tube through said slit.

5. Military equipment according to claim 1, wherein said craddle is provided with abutting means cooperating with stationary means for limitation of the forward and rearward movement of said craddle.

6. Military equipment according to claim 1, further comprising means for moving said craddle between said axial position and said lateral position include an endless chain carried by guiding and driving wheels supported by said frame, said chain having a driving finger slidably received in a transverse member of said carriage located perpendicularly to said slideway.

7. Military equipment according to claim 1, wherein said means for moving said craddle comprises at least one endless chain carried by said carriage and cooperating with means formed on the craddle.

8. Military equipment according to claim 1, further comprising means carried by said craddle for ramming said round of ammunition into the gun when said craddle is aligned with the gun.

9. Military equipment according to claim 8, wherein said means for ramming the round of ammunition comprises an endless chain provided with a loading finger arranged for abutting an end wall of said round of ammunition and for unlocking means for retaining said round of ammunition within said craddle.

10. A turret assembly for an armoured land vehicle comprising:

a turret mounted on said vehicle for rotation about a substantially vertical axis and arranged to accomodate crew members, means inside the turret for storing individual rounds of ammunition of a predetermined caliber at a plurality of locations reachable by one of the crew members, a loading station reachable by said one of the crew members for receiving said individual rounds one at a time, a gun of said caliber located out of and above said turret and of a type having a breech for shot by shot loading with said rounds of ammunition, a shield for said gun separate from said turret, enclosing said breech and securely connected to said gun, a pair of side members securely connected to said turret, projecting upwardly from said turret and defining bearing means supporting said shield and gun for rotation about an elevation axis transverse to said vertical axis and rearwardly thereof, said side members being constructed and arranged to define in cooperation with said shield a protected passage from said loading station to the inside of said shield, a unitary gun loading system located within said protected passage arranged to carry one round of ammunition at a time from a predetermined location and to insert said round into a firing chamber of said gun, said loading system being arranged to accomodate the variations in elevation, wherein said gun loading system constitutes a unitary assembly located within said separate shield and comprises a frame constructed and arranged to be secured to said separate shield, a slideway carried by said frame, a carriage supporting a craddle arranged to receive one round of ammunition at a time and slidably received on said slideway for movement between an axial position where said craddle supported by the carriage is aligned with said gun and a position lateral to said gun, and means for moving said craddle parallel to said gun between a rear position for transport by the carriage and a front position accessible from inside the turret for placing one round of ammunition therein, and wherein said means for moving said craddle parallel to said gun include power means and guide means arranged for swinging said craddle for giving it a downward slope when said craddle is moved toward said front position.

11. Military equipment comprising: a turret mounted on a mount for rotation about a substantially vertical axis; a pair of side members secured to said turret and projecting upwardly therefrom; bearing means carried by said side members and defining an elevation axis transverse to said vertical axis; a main gun of a caliber greater than that suitable for belt feed of ammunition and located out of and above said turret, carried by said bearing means and provided with a separate shield fast with said gun, said bearing means cooperating with the shield of the gun to define a protected passage; and a gun loading system, at least a portion of which is located in said protected passage, arranged to carry one round of ammunition at a time from a predetermined location and to insert said round into a firing chamber of said gun, said loading system being arranged to accomodate the variations in elevation, wherein said gun loading system constitutes a unitary assembly located within said separate shield and comprises a frame constructed and arranged to be secured to said separate shield, a slideway carried by said frame, a carriage supporting a craddle arranged to receive one round of ammunition at a time and slidably received on said slideway for movement between an axial position where said craddle supported by the carriage is aligned with said gun and a position lateral to said gun, means for moving said craddle parallel to said gun between a rear position for transport by the carriage and a front position accessible from inside the turret for placing one round of ammunition therein, and wherein said means for moving said craddle are arranged to subject said craddle to a swinging movement about a horizontal axis transverse to the axis of said gun when moving said craddle from said rear position where an axis of said craddle is parallel to said gun and a front position where said axis of said craddle has a forward slope, whereby placing of one round of ammunition is rendered easier.

12. Military equipment according to claim 11, wherein one of the end portions of said tube is provided with rollers supported by means for guiding said tube during forward and rearward movement thereof.

13. Military equipment according to claim 11, wherein said tube is formed with a longitudinal slit, further comprising means for axially ramming said round of ammunition from the tube into the firing chamber which comprises a finger projecting into said tube through said slit.

* * * * *

UNITED STATES PATENT AND TRADEMARK OFFICE

CERTIFICATE OF CORRECTION

PATENT NO. : 4,617,852

DATED : October 21, 1986

INVENTOR(S) : ALLAIS et al.

Figure 1A:
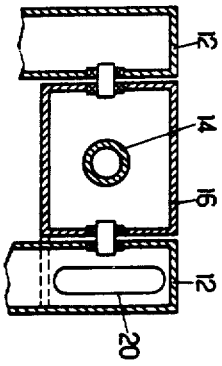
FIG. 1A is a sectional view through a plane passing through the axis of the swivel pins of the weapon of FIG. 1.

It is certified that error appears in the above-identified patent and that said Letters Patent is hereby corrected as shown below:

Figures 1A and 4 should appear as shown on the attached sheet.

Signed and Sealed this

Twenty-eighth Day of April, 1987

*Attest:*

DONALD J. QUIGG

*Attesting Officer*

*Commissioner of Patents and Trademarks*